United States Patent [19]

Palmer et al.

[11] 4,399,420

[45] Aug. 16, 1983

[54] MAIN CIRCUIT BREAKER

[75] Inventors: Neil R. Palmer, Swisher; John M. Winter, Cedar Rapids, both of Iowa

[73] Assignee: Square D Company, Palatine, Ill.

[21] Appl. No.: 301,354

[22] Filed: Sep. 11, 1981

[51] Int. Cl.[3] ..... H01H 73/48

[52] U.S. Cl. ..... 335/21; 335/23; 335/35

[58] Field of Search ..... 335/21, 23, 35, 188, 335/191, 201

[56] References Cited

U.S. PATENT DOCUMENTS

| | | | |
|---|---|---|---|
| 4,011,420 | 3/1977 | Heft | 335/201 |
| 4,291,291 | 9/1981 | Merchant | 335/188 |
| 4,307,359 | 12/1981 | Schultz | 335/191 |

*Primary Examiner*—Harold Broome
*Attorney, Agent, or Firm*—Larry I. Golden; Norton Lesser; Richard T. Guttman

[57] ABSTRACT

The following specification describes a circuit breaker having a handle pivoted about an axis transverse to the axis of blade rotation for controlling an operating assembly to pivot a cam about an axis parallel to the blade axis to open or close the breaker contacts. The operating assembly is located in the center compartment of the breaker while the contacts and blades are located in end compartments of the breaker, and when the blades are moved past a predetermined position, they are then independently moved by a respective snap acting spring. Sensing means control the operating assembly in the event of a fault current to move to a trip position and open the contacts while providing a visual signal of the trip condition. Arc gases are vented to prevent engagement with the copper conductor connected to each contact and a stainless steel blade bracket is interposed between the movable contact and the copper blade to prevent an arc from contacting the copper blade.

29 Claims, 14 Drawing Figures

MAIN CIRCUIT BREAKER

BACKGROUND OF THE INVENTION

1. Field of the Invention

This invention relates in general to circuit interruption apparatus and more particularly to an improved and more economical circuit breaker adapted for use at either the top or bottom of a panelboard.

2. Summary of the Prior Art

Panelboards comprise cabinets in which a source of electrical power is connected through one wall to a main circuit breaker which extends the power through downstream circuit breakers to respective loads. It is often desirable to extend the source of electrical power through the top wall of the panelboard to the main circuit breaker. In this case the main circuit breaker is located adjacent the top of the panelboard for feeding the downstream breakers located therebelow. Extending the source of power through the top wall of the panelboard however may not be the most convenient or economical practice since the source may be more conveniently introduced through the bottom wall of the panelboard.

On the other hand the main circuit breaker is usually constructed with a pivoted handle indicating the ON position of the breaker, when located adjacent the top of the panelboard, by pointing upward at the top limit of handle movement. Locating the main circuit breaker at the bottom of the panelboard on the other hand causes the handle to point downward when in the ON position due to the reversal of the normal limit positions of the breaker handle. The handle of a breaker at the bottom of the panelboard therefore indicates the ON position when the circuit breaker is actually OFF and indicates the OFF position when the circuit breaker is ON thereby contributing to a hazardous situation.

Underwriters' Laboratories has therefore required that pivoted circuit breaker handles either indicate the ON position by pointing upwardly or that the handle be movable horizontally so as not to mislead the operator as to the actual condition of the breaker. The requirement that the circuit breaker handle point up, limits the versatility of such circuit breaker for use in a so called bottom feed panelboard in which the supply is extended through the bottom wall. The sidewise or horizontal movement of the handle, however, is difficult to provide economically, as horizontal movement requires the handle and blades to pivot in directions transverse to each other instead of in parallel directions as is conventionally done.

Conventional circuit breakers often permit the handle to be moved to the OFF position and retained there even if the contacts are welded closed, since the blade closing springs interconnecting each blade with a trip bar may yield to the movement without causing the welded contacts to open. This condition is also misleading and can be dangerous as the operator may believe the circuit is open when it is in fact closed.

In addition circuit breakers commonly employ long distances between the blade pivot and the contacts in order to provide sufficient mechanical force to open the contacts quickly and to permit blow open forces to also open the contacts. Long blades in turn require substantial copper which is expensive.

SUMMARY OF THE INVENTION

The present invention provides an economical main circuit breaker in which the handle moves in a horizontal plane transverse to the plane in which the blades pivot and transverse to the longitudinal axis of the bus bars. The breaker can be therefore mounted adjacent either the top or bottom of a panelboard without the handle incorrectly indicating the breaker condition. This permits greater versatility in providing the electrical power supply to the panelboard through either the top or bottom walls or for either top or bottom feed panelboard.

The breaker operating mechanism is arranged in a center compartment and includes a plurality of links interconnected with the handle for pivoting movement in a horizontal plane parallel to the handle movement for transmitting a pivoting force through a pair of cams pivotable about an axis transverse to the longitudinal bus bar axis. The blades are located in respective end compartments of the breaker for pivoting movement by a respective cam about an axis parallel to the cam axis and transverse to the bus bar axis.

The blades are engaged by a respective pivoted force link and moved past a predetermined position on the respective force link by the cams, and thereafter, snap acting springs divorced from the handle and operating mechanism move the blades through the respective force link. The contacts are located further from the respective blade pivot axis than the distance between blade pivot axis and the force link so that blow open forces can operate efficiently to open the contacts, if necessary, and the blow open force need only operate against the snap acting springs.

If the contacts are welded, the cams cannot be effectively moved to open the contacts. A stop on one of the cams then limits the handle movement to prevent latching of the breaker in the event movement of the handle is attempted to clearly indicate a welded contact condition under those circumstances. This avoids misleading the operator into believing the circuit is open, while a visible indicator normally effective to indicate a tripped condition is prevented from doing so, when the contacts are welded.

The independent movement of the blades relative the handle also allows the contacts and mechanism to trip open even if the handle is held in the ON position under a fault current condition and to visibly indicate the trip condition under these circumstances and prevent misleading the operator into believing the circuit is open.

Further, the invention provides for venting of exhaust gases in the direction of the line terminal with a metal bracket capable of withstanding high temperatures carrying each copper blade and interposed between the vent gases and the respective blade. The brackets minimize the possibility of the vent gases engaging the blades, their copper pigtails or associated copper terminals.

It is therefore an object of the present invention to provide an improved and/or more economical circuit breaker.

It is another object of the present invention to provide an improved circuit breaker adapted for use in either a top or bottom feed panelboard.

It is another object of the present invention to provide for improved contact opening or closure in a circuit breaker.

It is still another object of the present invention to provide clear indications of contact conditions in a circuit breaker and particularly in a circuit breaker arranged for handle movement about an axis transverse to the axis about which the blades move.

It is still a further object of the present invention to provide improved protection of circuit components under fault conditions and it is an additional object to provide improved circuit breaker response to a fault condition.

Other objects and features of the present invention will become apparent on examination of the following specification and claims together with the accompanying drawings.

DESCRIPTION OF THE PREFERRED EMBODIMENT

Figure 1:
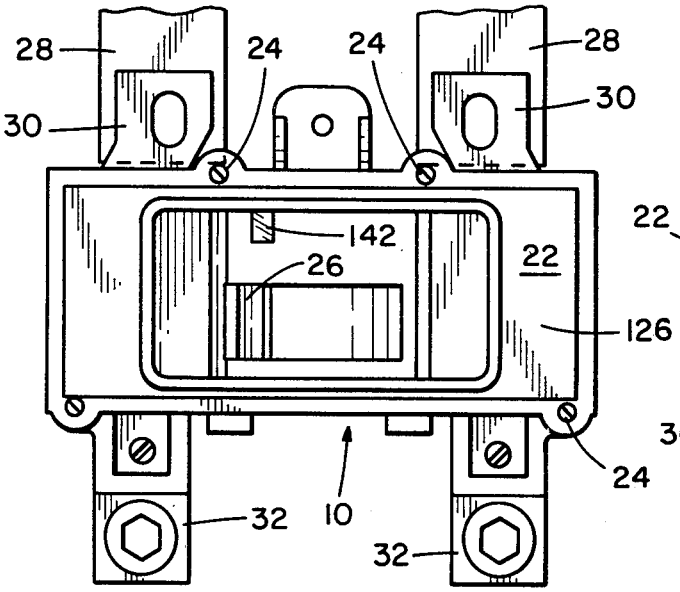
FIG. 1 is a top elevational view of the circuit breaker incorporating the principles of the present invention and arranged for a panelboard having bottom feed power supply cables.

In FIGS. 1–4 a circuit breaker incorporating the principles of the present invention is indicated by reference character 10. The circuit breaker 10 is adapted to carry 225 amps at substantially 120/240 volts for use as a main breaker in a panelboard and includes a base 12 carrying an operating mechanism or assembly 14 in a central compartment 16 and respective blade assemblies 18 located in end blade compartments 20 as best seen in FIGS. 5–12. The mechanism 14 and blade assemblies 18 are overlapped by a cover 22. The cover 22 is secured to base 12 by fasteners 24 and a handle 26 extends through the cover 14 for manually controlling the circuit breaker.

The panelboard has conductors or bus bars 28 connected from the main circuit breaker 10 to one or more downstream circuit breakers (not shown). The main circuit breaker 10 is connected to a source of electrical power entering the panelboard from either the top or bottom of the panelboard. The circuit breaker 10 includes respective load and line terminals 30 and 32 respectively each having means for respectively connecting and securing the circuit breaker 10 to bus bars 28 and to respective line conductors or cables which extend through either the top or bottom of the panelboard. Therefore the main circuit breaker 10 is located either at the top or at the bottom of the panelboard respectively.

Figure 1A:
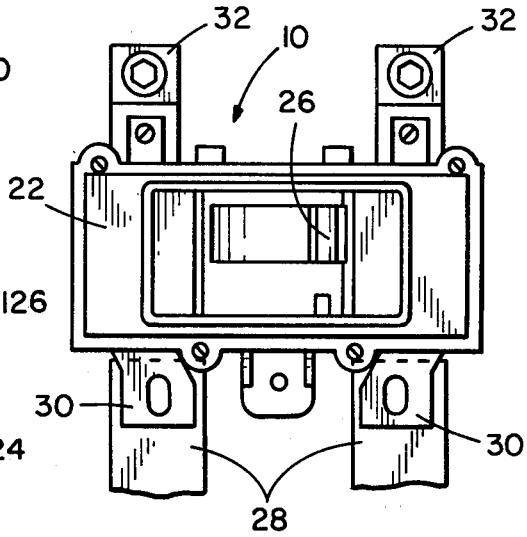
FIG. 1*a* is a top elevational view of a circuit breaker similar to that shown in FIG. 1 and arranged for a panelboard having top feed power supply cables.
Figure 2:
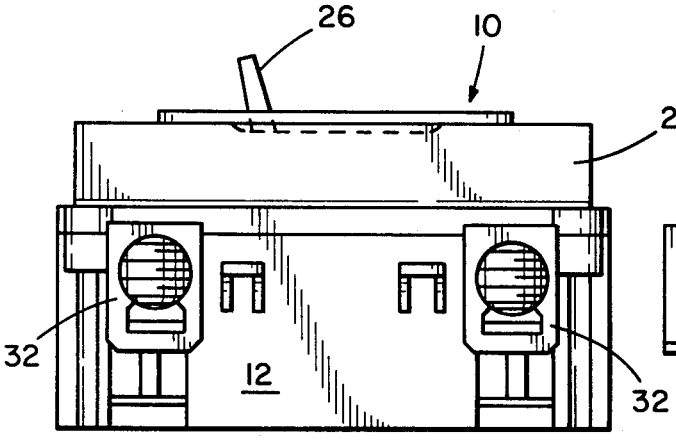
FIG. 2 is a rear elevational view of the circuit breaker shown in FIG. 1.
Figure 3:
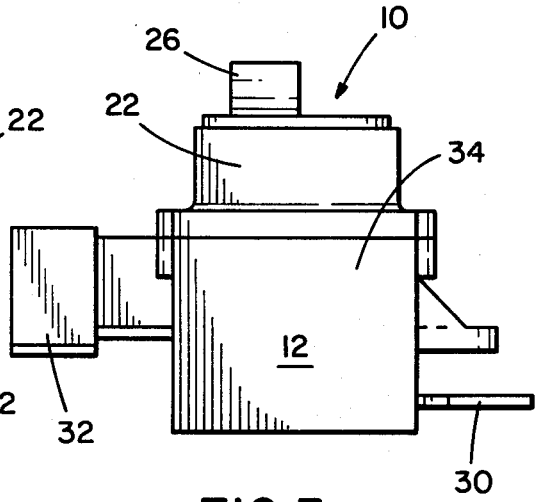
FIG. 3 is a side elevational view of the circuit breaker shown in FIGS. 1 and 2.
Figure 4:
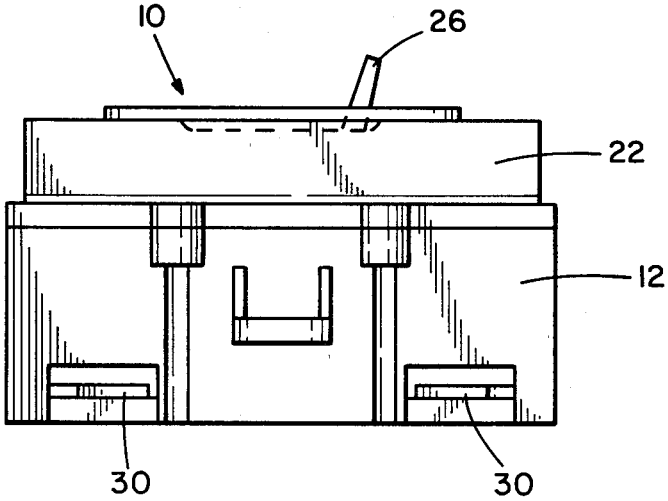
FIG. 4 is a front elevational view of the circuit breaker shown in FIGS. 1–3.
Figure 5:
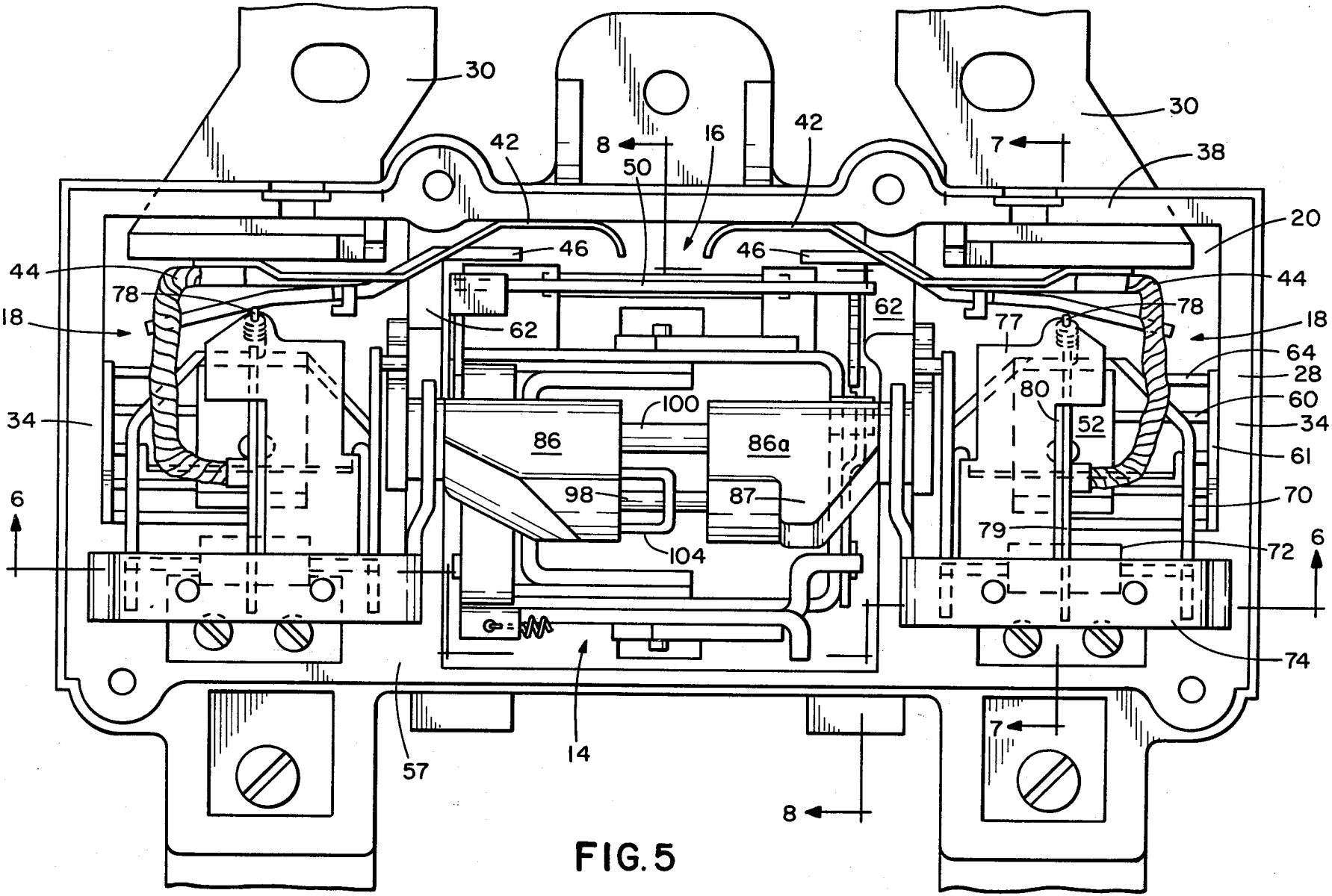
FIG. 5 is a top elevational view of the circuit breaker shown in FIG. 1–4 with the cover removed.

If the circuit breaker is at the bottom of the panelboard, the handle 26 of the breaker is operated from the ON position shown in FIG. 1 to the OFF position by movement from left to right, while if the circuit breaker is at the top of the panelboard as indicated in FIG. 1*a* the handle 16 is moved from the ON position shown at the right toward the left to the OFF position and in either event is moved in a horizontal direction transverse to the longitudinal axis of the bars 28.

A conventional breaker with a handle pivoted in a direction generally parallel to the longitudinal axis of bus bars 28, if located at the top of the panelboard would have its handle pointing upward to indicate the ON condition and if located at the bottom of the board, would be reversed, and therefore its handle would point down, when in the ON condition, to incorrectly indicate the circuit breaker was off.

As seen in FIGS. 5, 7, 8, 10 and 11 each load terminal 30 is L-shaped and extends into a respective blade compartment 20 of the breaker adjacent respective end walls 34 of the base 12.

The terminals 30 are each secured to bottom wall 36 of the base by means of a tab and fasteners. One leg of each terminal 30 extends upwardly along the front wall 38 of the base and a tab at the upper end thereof engages the cover. A boss projects from the front wall 38 to assist in properly securing the breaker in the panelboard. The upwardly extending leg of each terminal 30 adjacent wall 38 also passes a respective U-shaped magnetic yoke 40, and a respective bimetal 42 together with a copper pigtail 44 are secured to the respective upper end of each upwardly extending leg of each terminal 30.

Each yoke 40 is formed of a magnetically susceptible material and has an armature 46 biased by a leaf spring 48 mounted on the yoke for pivotal movement against the bias of spring 48 in response to a fault current above a predetermined value passing through terminal 30. The armature 46 and the bimetal 42 each project from the respective compartment 20, as seen, for example, in FIG. 5, into the central compartment 16 of the breaker for operating a trip plate 50 associated with the operating assembly or mechanism 14 of the breaker in response to a high fault or overload current respectively.

Each pigtail 44 extends to a respective movable copper slug or blade 52. Blade 52 carries a respective contact 54 adjacent one end for engaging a respective stationary contact 56. Contact 56 is secured to one end of the respective line terminal 32 so that a circuit is extended when the breaker is ON from each line terminal 32, through respective contacts 56 and 54, blade 52 and pigtail 44 to a respective terminal 30.

Each line terminal 32 is secured to the base by respective fastener means extending into respective bosses on the rear wall 57 of the base and lugs are secured to the terminals to assist in extending connections from the power supply cables or conductors. The contacts 54 and 56 are located adjacent an arc suppressor assembly 58 positioned at the bottom of a respective blade compartment 20. Each suppressor assembly 58 includes an arc runner plate 59 and a plurality of aligned U-shaped suppressor plates 60 with the space between the legs of the plates 60 accommodating movement of the respective blade 52 and contact 54. The plates 60 are mounted between insulating members 61, which are inserted between a respective end wall 28 of the base and a respective compartment wall 62 located intermediate the end walls 28 and partially defining the central compartment 16. An insulating member 64 extends between members 60 at a position spaced from the front and rear walls 38 and 57 and vent gases are directed through an opening or vent 66 in the rear wall 57 of the breaker located just below the line terminal 32. Vent 66 is spaced from the respective copper blades 52 and the copper pigtail 44 and its terminals in the event the contacts 54 and 56 are opened under a relatively high fault or short circuit currents and the gas is directed from the downstream bus bars. A metal screen (not shown) to prevent foreign objects from being introduced into the breaker and interfering with blade movement may also be placed in the vent opening and in the openings provided for terminals 30.

Figure 7:
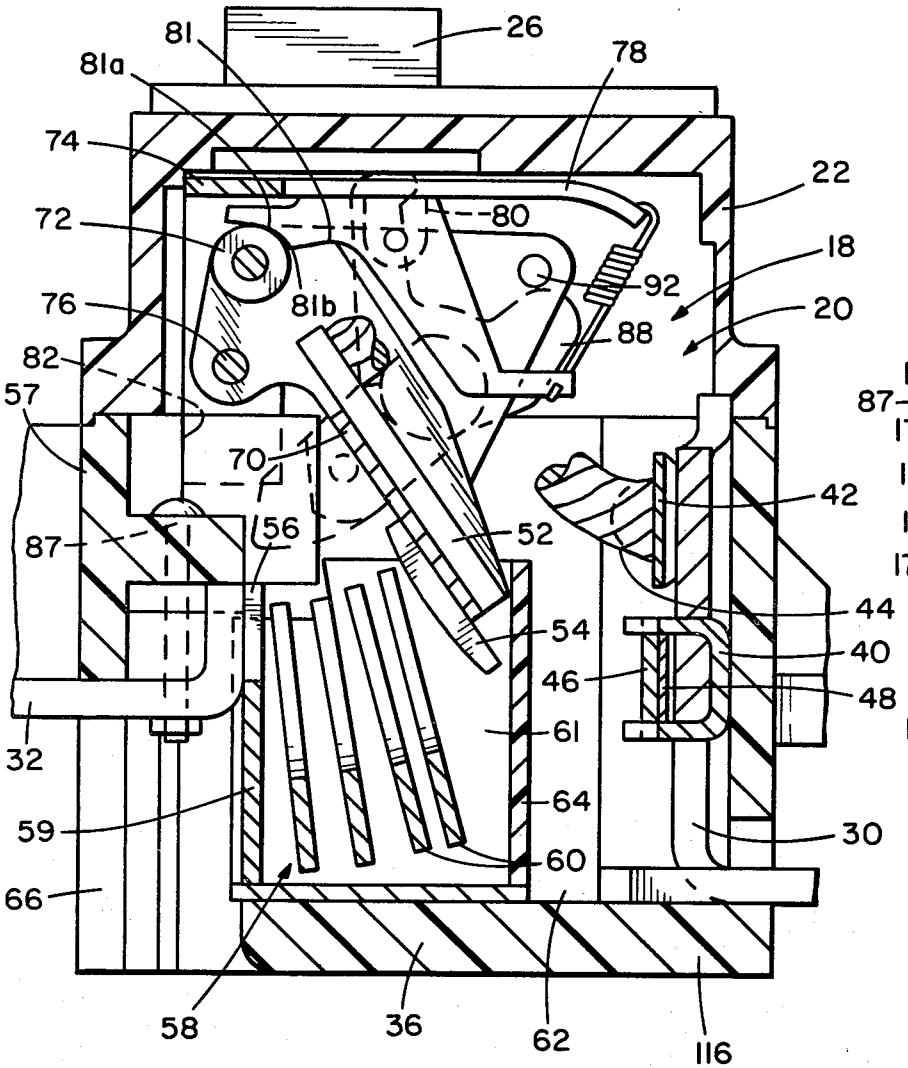
FIG. 7 is a sectional view taken along the lines of 7—7 in FIG. 5.
Figure 13:
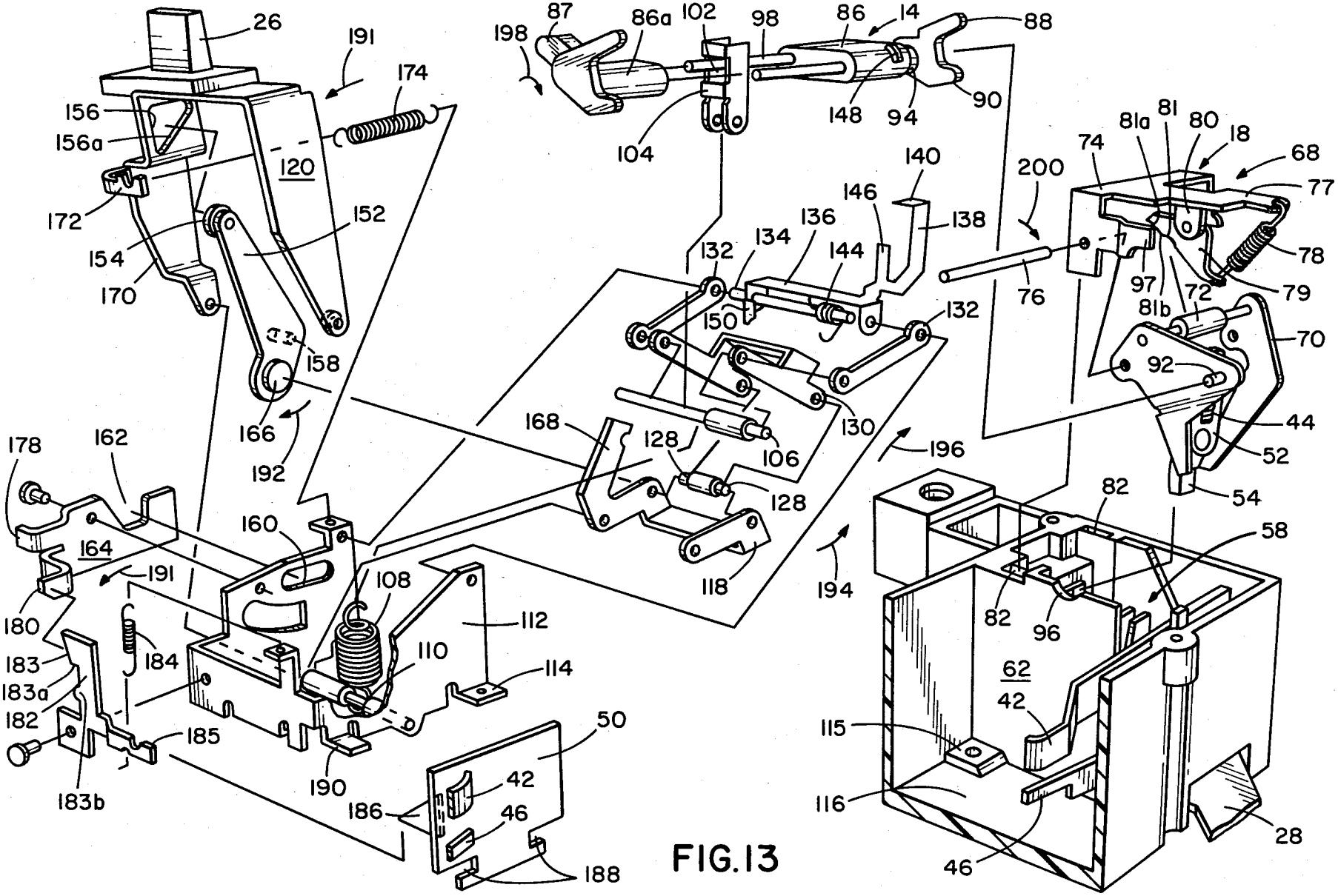
FIG. 13 is a exploded isometric view of the relevant portions of the circuit breaker mechanism and one of the blade assemblies.

Each blade assembly 18 is under control of operating assembly 14. The blade assembly includes a stainless steel U-shaped blade bracket 70 having the back leg supporting or carrying the blade 52 and interposed between the copper slug or blade 52 to prevent any arc from contacting the copper blade and connected pigtail, as seen in FIGS. 7 and 13. A roller pin 72 is pivotally supported between the side legs of each bracket 70.

Blade bracket 70 and blade 52 are pivotally supported between the side legs of a second U shaped bracket 74 by means of a pin 76 for pivoting movement in a vertical plane transverse to the longitudinal axis of bus bars 28. Pin 76 is located generally in line with contact 56 and relatively close to the axis of pin 72 as compared with the distance between pin 76 and contacts 54 and 56. The back leg of bracket 74 has a cantilever portion 77 extending therefrom to which one end of a helical spring 78 is secured. The other end of the spring 78 is secured to one end of a force link 79 supported on a downwardly extending leg 80 of cantilever portion 77 for pivoting movement along an axis parallel to pins 72 and 76 at a position relatively close to those pins as compared with the distance to the contacts. The spring 78 biases the force link 39 counterclockwise about its pivot as seen in FIG. 13 and has a portion extending forwardly of the pivot on leg 80 and therebelow for engaging pin 72 to provide snap acting engagement and disengagement of contacts 54 and 56.

The forwardly extending portion of force link 79 has a lower edge in engagement with roller pin 72 with the lower edge having a point **81*b* formed therein at the juncture of an arcuate surface 81 and an inclined surface 81*a*. The point 81*b* is closer to pin 76 than surfaces 81 and 81*a* so that when pin 72 moves past the predetermined position defined by point 81*b*, the link 79 pivots to tense spring 78 to snap actingly move pin 72 and snap actingly engage or disengage contacts 54 and 56. Surface 81 extends at an angle of substantially 12 degrees to a horizontal axis from point or juncture 81*b* while surface 81*a*** extends at substantially 30 degrees to a horizontal axis so that an obtuse angle greater than 90 degrees is formed therebetween.

The depending or lower end of the side legs of bracket 74 extend into a respective recess 82 in the top margin of the respective side or end wall 34 and a respective compartment wall 62, as best seen in FIG. 13, to seat the respective assembly 18 in the respective compartment 20 above the suppressor assembly 58.

The operating assembly 14 includes a pair of spaced apart plastic or delrin cams 86 and **86*a* each having a radial end wall with radially projecting end fingers 88 and 90 defining cam surfaces or cam means. At enlarged radial boss or stop 87 is formed on cam 86*a* at a position generally diametrically opposite respective finger 88 to prevent movement of handle 26** to the OFF position in the event the contacts are welded as will be explained.

The fingers 88 and 90 are located in a respective compartment 20 for engagement with a respective pin 92 projecting from a side leg of a respective bracket 70. Pin 92 is spaced a substantially greater distance from pin 76 then the distance between pins 72 and 76 to provide leverage.

Each cam 86 and **86*a* has a respective recessed bearing surface 94 adjacent a respective radial end wall. Each surface 94 is received in a respective journal or bearing formed by a recess 96 in a respective compartment wall 62 to rotatably support the cams in the walls 62 and hold the cams against axial movement. Arm 97 extending from one side leg of each bracket 74 overlaps a respective surface 94 and has a lower arcuate surface to engage a respective surface 94. As the brackets 74 are overlapped by the cover, the cams 86 and 86*a* are prevented from disengaging upwardly from the recesses 96. The cams 86 and 86*a* are connected by a pair of pins 98 and 100 with pin 100 in line with the axis of rotation defined by bearings 96, and transverse to the plane of movement of the blades 52 and contacts 54 but parallel to the axis of rotation of blades 52**.

Pin 98 passes through an opening 102 in the back wall of a U-shaped cam bracket 104. Bracket 104 has a pair of spaced apart depending legs extending therefrom to rotatably support the bracket on a link pin 106 for pivoting movement in a plane transverse or perpendicular to pins 98 and 76.

Link pin 106 is a translatable pin extending transverse to pins 98 and 100 and is connected to an end of a toggle or main helical spring 108 of the breaker. The other end of the spring 108 is secured between spacers to a pin or main shaft 110. Shaft 110 is supported adjacent the lower end of the legs of U-shaped frame or member 112. Frame 112 has tabs 114 on its side legs for securing the frame member 112 to raised bosses 115 on the bottom wall 116 of the breaker.

The shaft 110 passes through the spaced apart legs of a U shaped lower toggle bracket 118 located between the legs of frame 112 and through the spaced apart legs of a U-shaped handle arm 120, whose legs straddle pins 98 and 100, the bracket 104 and the legs of frame 112. A washer on the inner surface of one side leg of arm 120 encircling shaft 110 serves to aid in positioning the arm and reducing flexure.

The back leg of the handle arm 120 is secured to the handle 26 with a plastic handle shield 122 interposed between the handle base and an opening 124 in the top wall 126 of the cover 22. The handle 26 projects through the opening 124 and the shield 122 is adapted to slide with the handle movement between a pair of guides on the lower surface of the cover 22 to maintain the opening closed. If desired or needed a handle extension lever may be pivotably secured to handle 26 and the lever may be folded into a position parallel to the cover top surface when not in use to facilitate closure of the panelboard door.

The legs of toggle bracket 118 carry a shouldered pivot pin 128, which in turn pivotally supports a U-shaped lower toggle link 130 adjacent one end of the legs of link 130. The other end of the legs of toggle link 130 are pivotally supported by means of pin 106 with pin 106 extending parallel to pins 110 and 128 and transverse to pins 98, and 100 and 76. A pair of spaced upper links 132 are also pivotally supported adjacent one end of links 132 on pin 106 and the other end of links 132 in turn are pivotally supported by a pin 134 located adjacent the upper end of frame 112. Pin 134 also pivotally carries a U-shaped indicator bracket 136.

An indicator leg 138 extends upwardly from the back wall of bracket 136 adjacent one side leg of bracket 134 and a horizontally bent tab or flag 140 secured at the upper end of leg 138 is colored red for visibility through plastic window 142 in the cover 22 to indicate when the breaker is in the tripped position. The bracket 136 is normally biased clockwise with respect to the links 132, as seen in FIG. 13, by a helical or torsion spring 144 wrapped about pin 134 and having one end engaged with bracket 136 and the other end engaged with the upper surface of one link 132. A leg 146 on the back wall of bracket 136 is adapted to be engaged by a stop 148 on cam 86 in he event movement of the handle is attempted when the contacts are welded. A bend or fold 150 on one side leg of bracket 136 located below the back wall of bracket 136 is adapted to engage one surface of a drive bracket or follower arm 152.

Drive bracket 152 has a follower pin 154 adjacent its upper end extending through a triangularly shaped opening or passage in one leg of handle arm 120 with the passage having a generally vertical edge 156 and a generally oblique or inclined edge **156*a* extending upwardly from the lower end or corner of edge 156. A roller pin 158 projecting from and pivotally supported on drive bracket 152 intermediate the bracket ends extends through an opening 160 in one side leg of frame member 112 for receipt in a recess 162 located in the upper surface of a latch member 164. Another pin 166 adjacent the lower end of arm 152 is overlapped by and engages an upwardly projecting inclined leg 168 extending from the end of one side leg of toggle link 118 adjacent shaft 110**.

The latch member 164 is received between an offset portion 170 of one leg of handle arm 120 and is pivotally supported on one leg of member 112. The offset portion 170 is provided with a tab 172 and a helical spring 174 is connected at one end to tab 172 and at the other end to a tab 176 on frame member 112. Spring 174 normally biases the handle arm 120 clockwise, as seen in FIG. 13 and counterclockwise as seen in other drawings, about pin 110. In addition a tab 178 at one end of latch member 164 is adapted to engage the offset portion 170 in response to handle arm rotation in the counterclockwise direction as seen in FIG. 13 and in the opposite direction as seen in other drawings.

Latch member 164 also has a latch tab 180 at the same end as tab 178 bent in the opposite direction for engagment by a latch 182. Latch 182 is pivotally supported on the back wall of frame member 112 for pivoting movement about an axis transverse to the pivot axis of latch member 164. The latch 182 has one leg 183 extending generally vertically from its pivot and a spring 184 engages a second generally horizontal leg 185 to bias latch 182 toward latch tab 180. Leg 183 has an undercut forming a horizontal surface or transverse latch surface **183*a* adapted for overlapping engagement with the tab 180 at a position opposing the bias of spring 184 to latch the breaker. A nub or projection 183*b* directly below surface 183*a* engages the tab 180 when the breaker is initially moved to the reset or OFF position to control the position of latch surface 183*a* with respect to tab 180. A radially extending surface on leg 183 above surface 183*a* also is adapted to engage tab 180** when the breaker is tripped.

The leg 185 of latch 182 is overlapped by a trip projection 186 extending from one surface of the generally planar rectangular plastic trip bar or plate 50 and integrally formed thereon. The opposite surface of plate 50 is adapted to be engaged by either one of the bimetals 42 or armatures 46 extending from a respective blade compartment 20.

Trip plate 50 is seated in a recess formed in the bottom wall 116 of the breaker between compartment walls 62 and is provided with a pair of notches 188 adjacent its lower edge for receiving a portion of tab 114 and a tab 190 on the frame member also seated on a raised boss. The plate 50 may therefore pivot from adjacent the front wall of the breaker toward a side leg of the frame member 112 in response to movement of a bimetal 42 or an armature 46.

Figure 6:
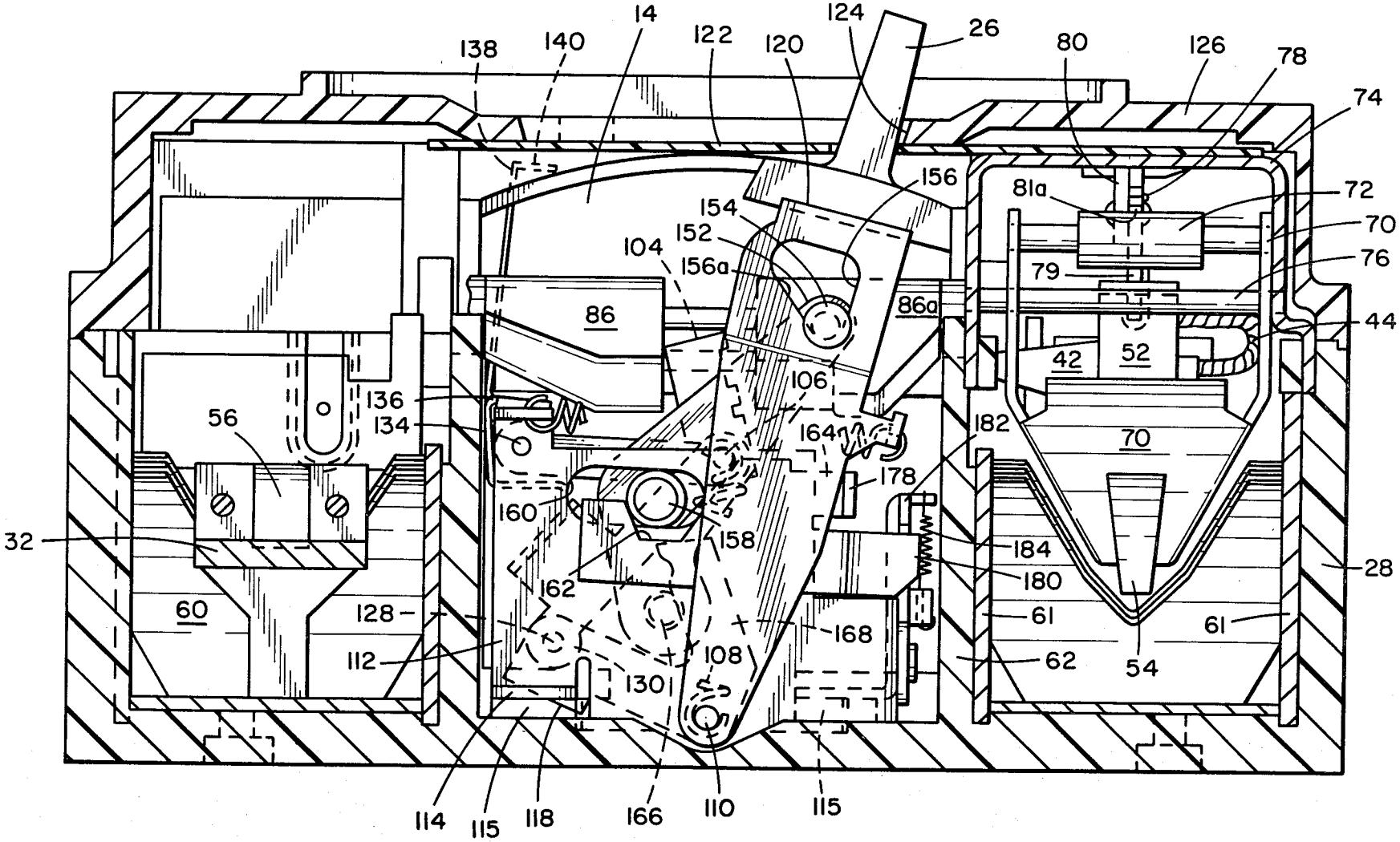
FIG. 6 is a sectional view taken generally along the lines of 6—6 in FIG. 5 and showing the circuit breaker in the OFF position.
Figure 12:
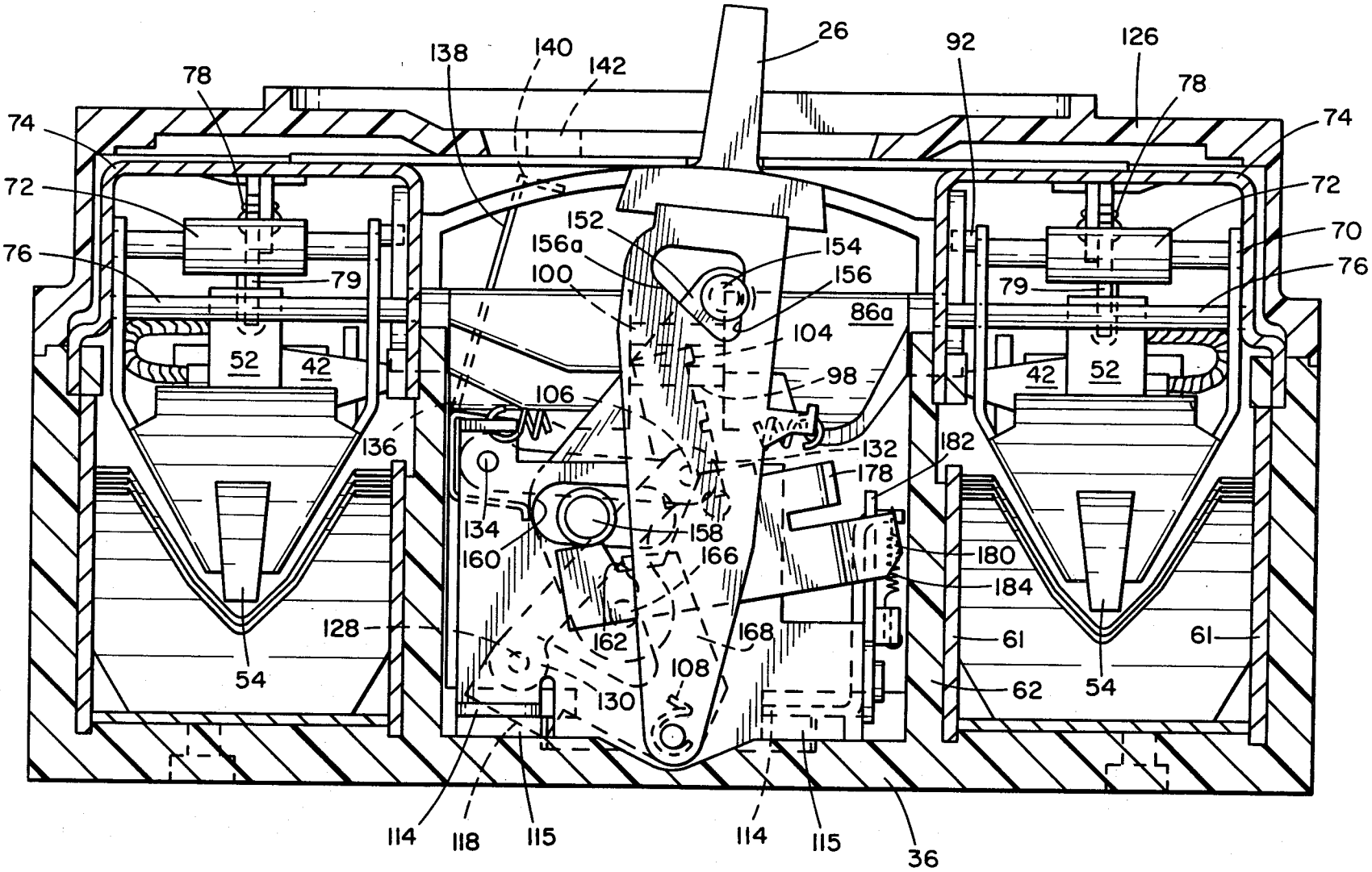
FIG. 12 is a sectional view generally similar to FIGS. 6 and 9, but showing the circuit breaker in tripped condition.

To close the breaker contacts 54 and 56 when the breaker is in the tripped position shown in FIG. 12, the handle 26 is first moved to the OFF position shown in FIG. 6 to reset the breaker. This movement is in the clockwise direction as seen in FIGS. 6 and 12 or in the opposite direction as indicated by arrow 191 in FIG. 13. As the handle 26 and the handle arm 120 move toward the OFF position about the axis of pin 110, the spring 174 is tensioned, while the pin 154 on drive arm 152 is engaged by the inclined edge **156*a*** of the handle arm passage.

Pin 158 on arm 152 moves somewhat to the right from the position seen in FIG. 12 under the influence of the inclined edge **156*a* so as to be aligned with recess 162 in the mechanical latch member 164 as seen in FIG. 6. As the drive bracket or arm 152 moves to the right or in the direction of arrow 191, if viewed in FIG. 13, offset portion 170 on arm 120 engages tab 178 to pivot latch member 164 clockwise as seen in FIGS. 6 and 12 or counterclockwise as seen in FIG. 13, until tab 180 strikes the upper edge of frame 112 to stop the movement while the projection 183*b* on latch leg 183 engages tab 180**.

Thereafter the tension of spring 174 returns the arm 120 a short distance, until the upper edge of tab 180 strikes surface **183*a* of latch 182, as that surface 183*a* overlaps tab 180 under the bias of spring 184. Pin 158 is then engaged with the front edge of recess 162 as seen in FIG. 6 to hold the arm 120 and handle 26 in the OFF position and the circuit breaker is latched as member 164 cannot pivot away from pin 158. Pin 154 is in the meantime moved relatively of the handle arm passage and is located adjacent the juncture of edges 156 and 156*a*. The breaker 10** is now reset.

During the movement from the trip position to the OFF position one edge of the drive bracket or follower arm 152 is moved from the fold 150 on the side leg of bracket 136. The bracket 136 pivots toward the adjacent wall 62 under the influence of spring 144 to move the flag 140 from the window 142 until tab 138 engages adjacent wall 62, which acts as a stop to hold flag 140 in a horizontal position displaced from window 142.

Figure 9:
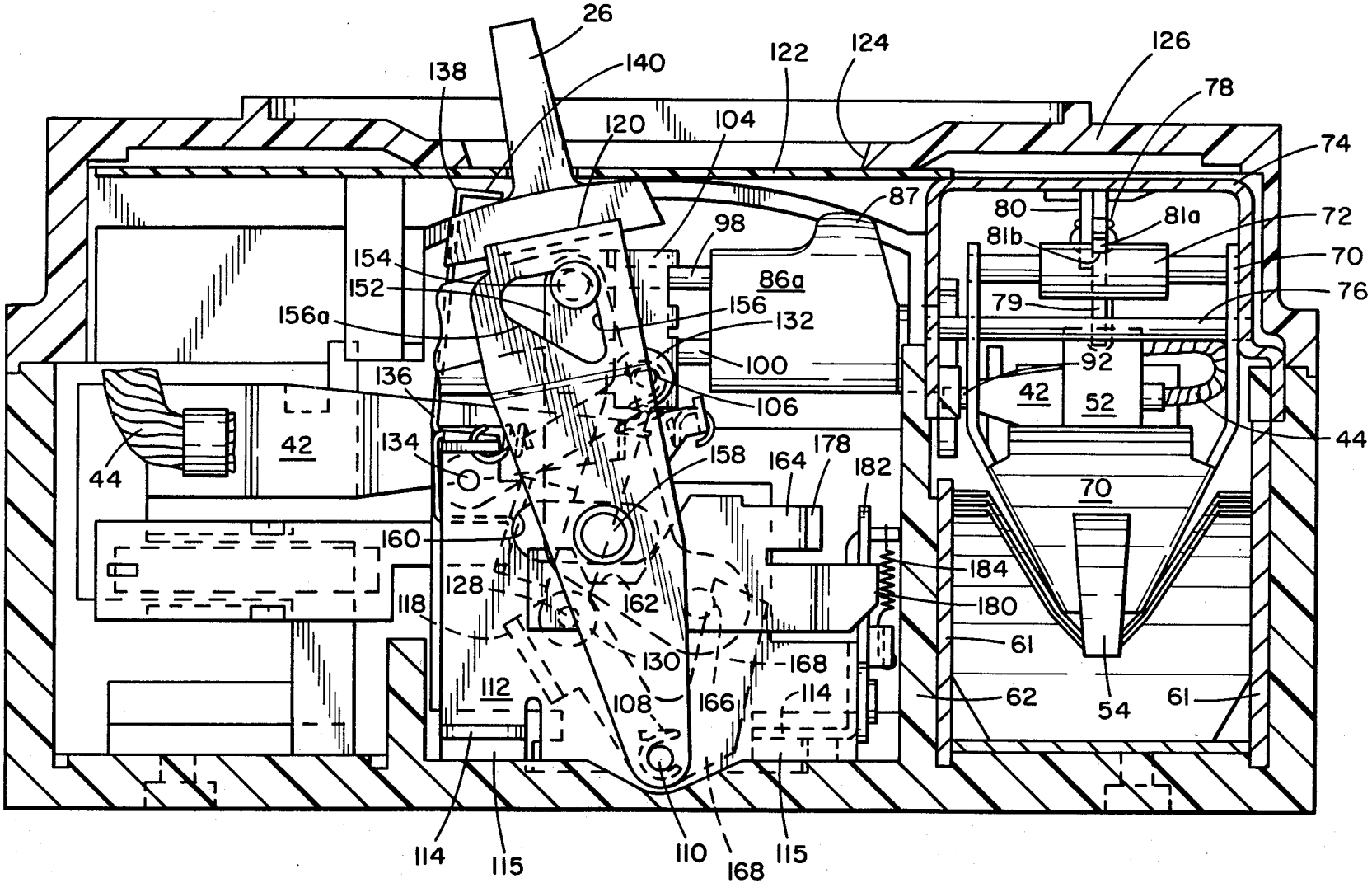
FIG. 9 is a sectional view generally similar to FIG. 6 but showing the circuit breaker in the ON position.

To place the breaker 10 in the ON position, the handle 26 and arm 120 are rotated from the OFF position seen in FIG. 6 in a counterclockwise direction to the ON position seen in FIG. 9. If the breaker is at the bottom of the panelboard, the rotation is from right to left as seen in FIG. 1 to place the handle 26 as seen in FIG. 1, while in the event the breaker is mounted at the top of the panelboard as seen in FIG. 1*a* the rotation is from the left to right to place the handle as seen in FIG. 1*a*. In neither case does the handle 26 point upwardly.

During rotation from the OFF position, arm 120 pivots about the axis of shaft 110 and pin 154 engaged by the rear generally vertical edge 156 of the handle arm passage pivots drive arm 152 counterclockwise, as seen in FIGS. 6 and 9 or in the direction of arrow 192 as seen in FIG. 13, generally about the axis of pin 158, which is held from translation by the short transverse edge of recess 162. Pin 166 therefore rotates counterclockwise, as seen in FIGS. 6 and 9 for applying force against arm 168 of toggle 118 with substantial leverage as the distance between handle 26 and shaft 110 is substantially greater than that between pin 158 and 166. Toggle bracket 118 therefore rotates clockwise about the axis of pin 110, as seen in FIGS. 6 and 9 or in the direction of arrow 194 as seen in FIG. 13 to bring leg 168 into a generally vertical position and pin 128 toward alignment with the shaft 110 and the pin 134.

As the upper links 132 can pivot about the axis of shaft 134, but cannot translate, pin 106 must rise to accommodate the movement thereby pivoting upper link 130 counterclockwise about the axis of pin 128, as seen in FIGS. 6 and 9 or in the direction of arrow 196, as seen in FIG. 13. As the pin 106 rises, the main spring 108 is extended to tension the spring 108, while simulataneously the vertical edge 156 of the handle arm moves past the center line of the breaker so that pin 154 moves upward relative the vertical edge 156 from the corner juncture with edge 156*a*. During upward movement of the pin or shaft 106, cam bracket 104 follows the movement.

As the cam bracket 104 rises, the lower edge of opening 102 engages against pin 98. As the cams 86 and 86*a* are restrained against upward movement by the bracket 74, the cams 86 and 86*a* pivot about the axis of pin 100 to pivot the radial end fingers 88 and 90 from the position seen in FIG. 8 to the position seen in FIG. 11 or in the direction of arrow 198 as seen in FIG. 13. The finger 88 of each cam 86 then engages the respective pin 92 to pivot the respective bracket 70 about the axis of pin 76 and from the position seen in FIG. 7 to the position seen in FIG. 10 or in the direction of arrow 200 as seen in FIG. 13, to move each blade 50 for engaging respective contacts 54 and 56.

Figure 10:
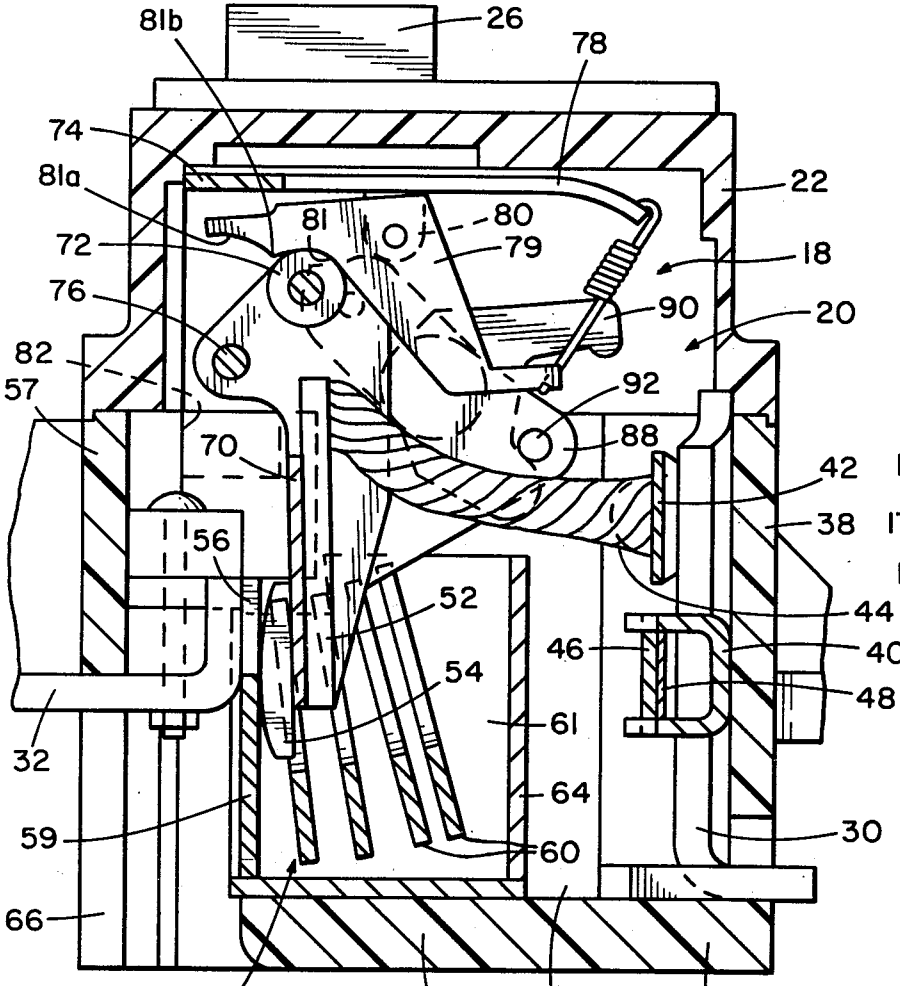
FIG. 10 is a sectional view generally similar to FIG. 7 but showing the contacts in the ON position.

As pin 72 moves from the position seen in FIG. 7 to the position seen in FIG. 10 or in the direction of arrow 200 as seen in FIG. 13, it moves from surface 81*a* on force link 79 to engage against the point or juncture 81*b* formed by surfaces 81 and 81*a* to apply additional tension to spring 78 and as soon as the juncture 81*b* is passed, the spring 78 rapidly moves the pin 72 and the bracket 70 to quickly engage contacts 54 and 56 with a snap action while the pin 72 seats on surface 81 behind the juncture of surfaces 81 and 81*a*. The snap action minimizes possibility of arcing, whereafter the contacts are held engaged under the pressure supplied by the tension of the respective spring 78 as pins 72 are disengaged from the respective fingers 88. It will be noted that the position of roller 72 along surface 81*a* is determined by the contact size and that as the contacts wear or erode, the roller position adjusts for the contact wear under the pressure of spring 78.

As the pin 106 moves upward, the links 132 pivot upward about the axis of pin 134 and the indicator bracket 136 is simply held against compartment wall 62 under the bias of spring 144 to hold the flag 140 from alignment with window 142.

The drive arm pin 166 moves along leg 168 of bracket 118 as the leg 168 is moved past a generally vertical position, until the pin 166 aligns with and engages in the recess 169 of leg 168. With pin 166 engaged in recess 169, the upper edge of recess 169 prevents further rotation of the drive arm or bracket 152 in the direction of arrow 192 as seen in FIG. 13. Further handle movement is also stopped, since the pin 154, which is now adjacent the upper corner of the edge 156 holds the edge 156 from further movement. The main spring 108 is now prevented from freely contracting, by latch edge 183*a* which overlappingly engages tab 180 thus restraining member 164 from pivoting movement. The front edge of recess 162 is therefore held engaged with pin 166 for preventing rotation of bracket 152 in the reverse direction to disengage pin 158 from recess 169 and allow spring contraction. The breaker is now in the ON position with contacts 54 and 56 closed.

To return the breaker to the OFF position from the ON position the handle 26 is moved in a direction for moving edge 156 from arm 152 as seen in FIG. 9. The handle 26 pivots handle arm 120 about the axis of pin 110 against the bias of spring 174 and when the upper corner of oblique edge 156*a* engages pin 154, the drive arm 152 is pivoted in a clockwise direction, as seen in FIGS. 6 and 9 and opposite that shown by arrow 192 in FIG. 13. The force applied to the drive arm 152, disengages pin 166 from the recess in arm 168, thereby allowing the main spring 108 to contract, while arm 152 follows the motion of edge 156*a*. As spring 108 contracts, it pulls pin 106 downward to pull cam bracket 104 down while toggle 118 and links 130 and 132 rotate back to their OFF position.

The upper edge of opening 102 in cam bracket 104 pulls pin 98 downward to rotate the cams 86 and 86*a* in the direction opposite to that described in moving to the ON position and in this case finger 90 engages pin 92 to rotate bracket 70 in a direction for disengaging contacts 54 and 56. As the distance between pins 92 and 76 is greater than the distance between pins 76 and 72, a large mechanical advantage is provided therefor to move pin 72 from surface 81 past the juncture 81*b* of the force link 79. The spring 78 is therefore again additionally tensed by roller pin 72, and as soon as the juncture 81*b* is passed, the spring 78 partially relieves its tension by transmitting its force though the force link 79 to pin 72 to open the contacts 54 and 56 with a snap action and minimize the possibility of arcing. As the roller 72 is snapped past juncture 81*b* to seat against surface 81*a*, the pin 92 disengages from finger 90 and is moved independently by spring 78 and link 80 to a position intermediate the fingers 88 and 90. The motion of the handle arm 120 may continue slightly past the OFF position until the offset portion 170 engages tab 178 to carry the tab 178 into engagement of the upper surface of frame member 112, however release of the handle 26 enables the spring 174 to simply return the handle arm 120 and handle 26 to the OFF position with edge 156 thereafter held by pin 154 against the tension of spring 174. The contacts 54 and 56 may thereafter be closed again as already described by movement of the handle to the ON position.

Had one or both sets of contacts 54 and 56 been welded closed, the movement of handle 26 toward the OFF position from the ON position rotates cams 86 and 87 as described to engage finger 90 with pin 92, however now instead of forcing roller 72 past juncture **81*b* to separate pin 92 from finger 90, the pin 92 remains engaged with finger 90 since the finger can not continue its travel without breaking the weld. If the weld doesn't break, cams 86 and 86*a* cannot rotate pins 92. With cams 86 and 86*a* held from rotation, the handle cannot move to the OFF or reset position since the projection 87 on cam 86*a* is then positioned to stop handle arm movement. Also with cams 86 and 86*a* prevented from rotation, the bracket 104 holds the spring 108 from collapsing even though the trip plate 50 may have operated the latch 182 to allow member 164 to pivot. If member 164 is free to pivot, pin 166 and drive arm 152 may be free to move somewhat to the left as seen in FIG. 9, but since cam bracket 104 is stopped as soon as it engages pin 98, this movement is limited and spring 108 does not collapse. The drive arm 152 may engage fold 150 and attempt to pivot bracket 136 for displaying flag 140 in window 142, but stop 148 on cam 86 engages leg 146 on bracket 136 to prevent movement of the flag into alignment with window 142. Preventing the handle arm 120 and handle 26 from moving to the OFF or reset position and handle release by the operator allowing spring 174** to return the handle, clearly indicates the welded contact condition so that the operator is not misled into believing the circuit is open.

While the breaker is in the ON position, a fault condition may occur. The bimetal 42 bends to engage plate 50, if the fault condition results from an overload current. Alternatively the armature 46 is pivoted if the fault condition is due to a fault current above a predetermined value, to engage trip plate 50. Plate 50 pivots toward the frame 112 causing projection 186 to pivot latch 182 from overlapping engagement with tab 180 and allowing pin 158 to pivot latch member 164 slightly counterclockwise as seen in FIG. 12 or clockwise as seen in FIG. 13 under the influence of spring 108. The pins 158 and 166 on drive bracket 152 are free to move from respective recesses 162 and 169. Movement of the drive bracket 152 toward the left as seen in FIGS. 9 and 12 with pin 158 guided by slot 160 engages one edge of bracket 152 with the fold 150 on bracket 136 to pivot flag 140 into alignment with window 142 for signaling the trip condition.

The main spring 108 is now free to contract in response to either fault condition, as the pin 106 is now free to move downwardly. As spring 108 contracts, it pulls pin 106 downward to pivot the toggle 118 and links 130 and 132 toward their OFF position while pulling bracket 104 down.

Figure 8:
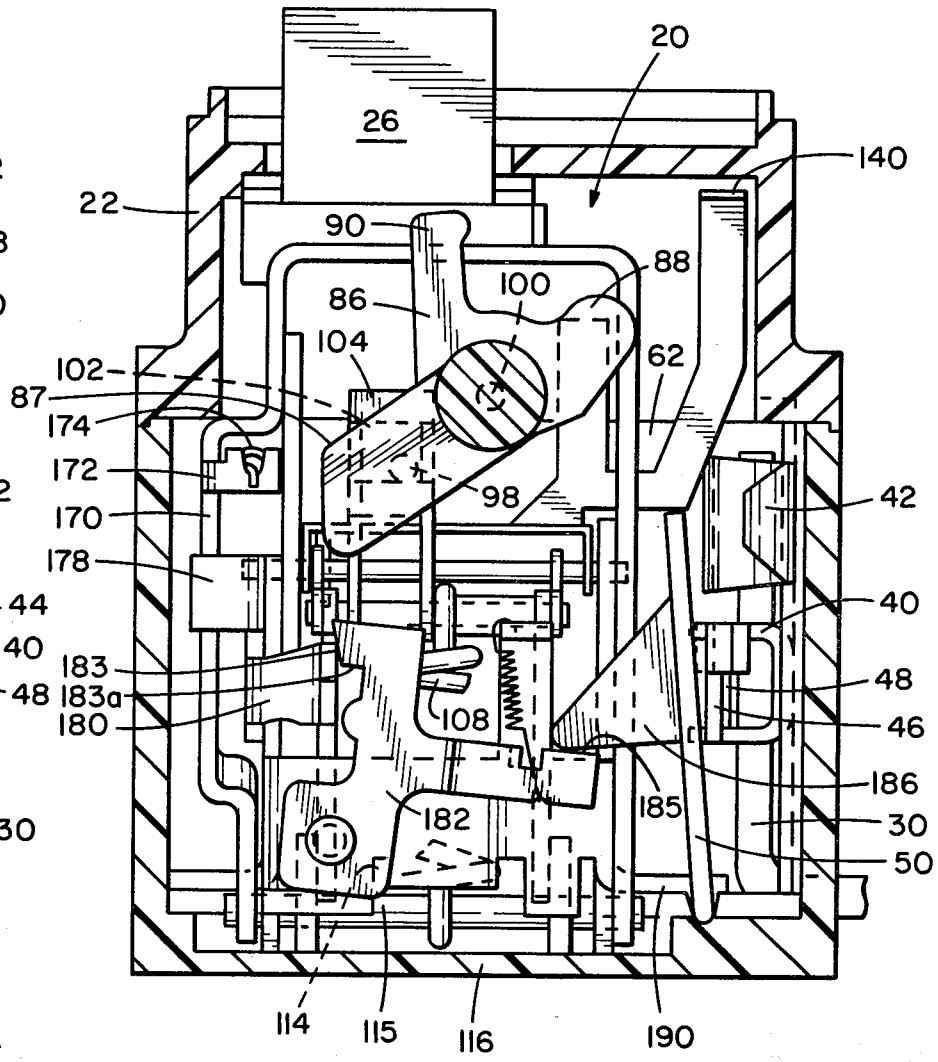
FIG. 8 is a sectional view taken along the lines of 8—8 in FIG. 5.
Figure 11:
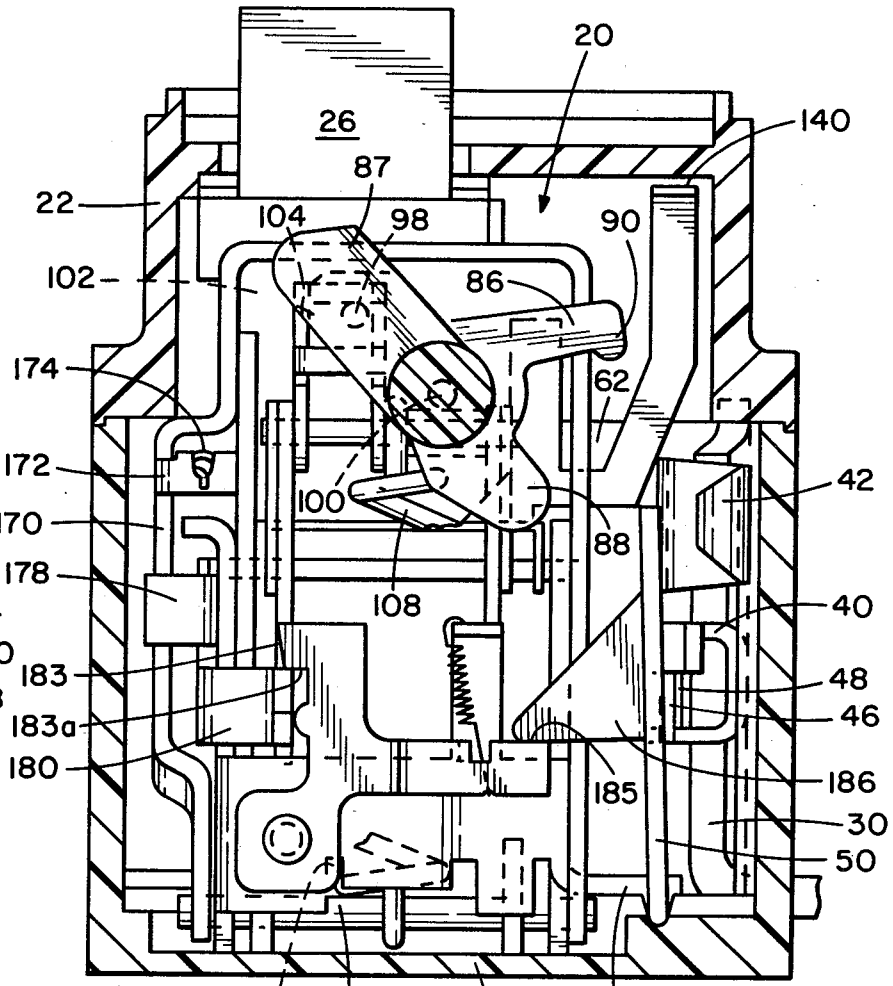
FIG. 11 is a sectional view generally similar to that shown in FIG. 8 but showing the mechanism in the ON position.

The upper edge of cam bracket opening 102 engages pin 98 to rotate the cams 86 and **86*a* from the position seen in FIGS. 10 and 11 to the position seen in FIGS. 7 and 8. Each radial finger 90 engages a respective pin 92 to open the respective contacts 54 and 56 as previously described. As pin 106 moves down, links 130 and 132 pivot clockwise about the axis of pins 128 and 134 respectively as seen in FIGS. 9 and 12 or opposite to arrow 196, as seen in FIG. 13**.

The circuit breaker 10 may thereafter be reset by moving the handle 26 to the OFF position as previously described and then to the ON position to close the contacts all as described.

In the event of large currents passing through contacts 54 and 56 of sufficient magnitude to create blow open forces, the contacts tend to separate due to the opposing magnetic fields. Those forces pivot bracket 70 about the axis pin 76 to move pin 72 past the juncture or point **81*b* formed by surfaces 81 and 81*a* of the force link 79 to open the contacts 54 and 56. Opening of contacts 54 and 56 may occur prior to the operation of the trip plate 50 with the spring 78 providing a snap action opening. The pin 92 may in its travel engage finger 88 to drive pin 98 forcibly against the lower edge of bracket opening 102. When the armature 46 operates trip plate 50, latch member 164 is released and the collapse of spring 108** places the breaker handle in the trip position.

Had the contacts 54 and 56 been closed under a fault condition or the handle 26 held in the ON position during a fault, the trip plate 50 operates as previously described for tripping the operating mechanism 14. As the spring 108 collapses, the contacts 54 and 56 are opened as previously described and the flag 140 moved into alignment with window 142. Since the movement of the drive arm 152 is toward the left as seen in FIG. 9 under a fault condition, this movement is not impeded if handle arm 120, is held manually in the ON position. Thus the circuit breaker trips open under a fault condition even if the handle is held in the ON position.

The foregoing is a description of an improved circuit breaker whose inventive concepts are believed set forth in the accompanying claims.

What is claimed is:

1. A circuit breaker for use in a panelboard having a power supply extending through either a top or a bottom wall of said panelboard to supply electrical power to a conductor having a longitudinal axis located in a vertical plane and adapted to be connected to a load, comprising:

a pair of contacts adapted to be connected between said conductor and said supply, pivot means for pivoting one of said contacts in one direction about a horizontal axis transverse to the longitudinal axis of said conductor for engagement with the other contact to extend power from said supply to said conductor and for disengagement from said other contact in response to pivoting movement of said one contact in the opposite direction about said horizontal axis to interrupt power to said load, an operating assembly having a handle projecting from said breaker for rotation about a vertical axis parallel to the longitudinal axis of said conductor whereby said handle moves in one horizontal direction to move said operating assembly to an ON position and moves said operating assembly to an OFF position in response to rotation of said handle in the opposite horizontal direction whereby said vertical axis is substantially perpendicular to said horizontal axis although not coplanar, and last means interconnecting said operating assembly with said pivot means for pivoting said one contact in said one direction in response to said operating assembly moving to said ON position and for pivoting said one contact in said opposite direction in response to said operating assembly moving to said OFF position.

2. The circuit breaker claimed in claim 1 in which said operating assembly includes a translatable pin extending parallel to said vertical handle axis, a link pivotable about said translatable pin, and said last means includeing cam means pivotable about an axis transverse to said translatable pin and parallel to said horizontal contact axis.

3. The circuit breaker claimed in claim 2, in which said vertical handle axis is defined by a selected pivot pin and said operating assembly includes a main spring having one end connected to said selected pivot pin and another end of said spring connected to said translatable pin.

4. The circuit breaker defined in claim 3 in which said operating assembly includes means for translating said translatable pin in a selected direction to a selected position for tensing said main spring in response to rotation of said handle in said one direction in said horizontal plane, and latching means for retaining said translatable pin in said selected position against the tension in said spring in response to said handle being rotated in said opposite horizontal direction prior to rotation in said one horizontal direction.

5. The circuit breaker defined in claim 4 in which said cam means includes a bracket pivotally supported on said translatable pivot pin for translation with said translatable pin, a cam member, means for pivotally supporting said cam member for rotation about said axis transverse to said vertical axis, and means responsive to translation of said bracket in said selected direction for rotating said cam member about said axis transverse to said vertical axis for pivoting the one contact.

6. In the circuit breaker claimed in claim 5, spring means effective in response to initial pivoting of said one contact in said one and opposite direction about said horizontal contact axis past a predetermined position by said cam member for thereafter snap actingly pivoting said one contact in the respective one and other direction independently of said cam means.

7. In the circuit breaker claimed in claim 6, sensing means for sensing a current above a predetermined level passing through said contacts, and controlling means controlled in response to the sensing of said current above said predetermined level for controlling said latching means to enable said main spring to translate said translatable pin for rotating said cam member to pivot said one contact in said other direction and from engagement with said other contact.

8. In the circuit breaker claimed in claim 7, trip indicator means operable in response to control of said latching means by said sensing means for providing a visual signal corresponding to said current above said predetermined level.

9. In the circuit breaker claimed in claim 7, means enabling said main spring to translate said translatable pin in response to the sensing of said current above said predetermined value irrespective of the movement of said handle in said one horizontal direction.

10. In the circuit breaker claimed in claim 9, stop means for preventing rotation of said handle in said opposite direction in said horizontal plane to prevent translation of said translatable pin from said selected position in the event said contacts are welded closed.

11. A circuit breaker for use in a panelboard having a bus bar to supply electrical power to a load, comprising:

a pair of contacts adapted to be connected between said bus bar and a load, pivot means for pivoting one of said contacts in one direction about a contact axis for engagement with the other contact to extend power from said bus bar to a load and disengaged from said other contact in response to pivoting movement in the opposite direction about said contact axis to interrupt said power to said load, an operating assembly having a handle arranged for rotation about a handle axis to control said operating assembly for movement to an ON position in response to rotation of said handle in a respective direction about said handle axis and into an OFF position in response to rotation of said handle opposite said respective direction about said handle axis, cam means interconnecting said operating assembly and pivot means in response to movement of said operating assembly to said ON position for pivoting said one contact in said one direction about said contact axis to engage said other contact with said one contact, said cam means interconnecting said operating assembly and said pivot means in response to movement of said operating assembly to said OFF position for pivoting said one contact in said other direction about said contact axis to disengage said one contact from said other contact, and spring means effective in response to initial pivoting of said one contact in said one and opposite directions about said contact axis past a predetermined position for thereafter snap actingly pivoting said one contact in the respective one and opposite direction independently of said cam means.

12. The circuit breaker claimed in claim 11 in which said spring means engage said pivot means at a position substantially closer to said contact axis than the distance between said contacts and said contact axis to enable blow open forces generated by a fault current of substantial magnitude to pivot said one contact in said opposite direction past said predetermined position for thereafter enabling said spring means to snap actingly pivot said one contact in said opposite direction.

13. The circuit breaker claimed in claim 12 in which said spring means engage said pivot means at a position substantially closer to said contact axis than the position at which said cam means are interconnected with said pivot means to provide said cam means with a mechanical advantage in pivoting said one contact past said predetermined position.

14. The circuit breaker claimed in claim 13 in which said operating assembly is movable into a trip position for controlling said cam means to pivot said one contact in said other direction past said predetermined position, and trip means are provided for moving said operating assembly into said trip position in response to current of greater than a predetermined magnitude passing through said contacts.

15. In the circuit breaker claimed in claim 14, means for enabling said operating assembly to be moved to said ON position in response to said handle being first rotated opposite said respective direction to a handle OFF position and thereafter rotated in said respective direction to a respective handle ON position, and means thereafter effective for enabling said handle to be manually retained in said respective position irrespective of the movement of said operating assembly to said trip position in response to engagement of said contacts.

16. In the circuit breaker claimed in claim 11 means for automatically preventing rotation of said handle from said respective direction in response to said contacts being welded closed.

17. The circuit breaker claimed in claim 11 in which said handle is rotated about one axis and said one contact is pivoted about an axis transverse to said one axis.

18. In the circuit breaker claimed in claim 11, a housing containing said contacts, operating assembly, handle, cam means and said spring means with said spring means including a force link having a pair of adjacent surfaces meeting at an obtuse angle to form a point therebetween, and said pivot means includes a bracket carrying a blade having said one contact thereon with said bracket adapted to pivot about a blade axis spaced from said one contact, and means on said bracket for engaging said point at a position spaced from said blade axis and generally diametrically opposed to said one contact.

19. In the circuit breaker claimed in claim 18, one terminal on one wall of said housing connected between said other contact and said bus bar, a second terminal on another wall of said housing, a metal having a relatively low melting temperature interconnecting said second terminal and said one blade, and a vent in said one wall adjacent said one terminal with said bracket carrying said blade formed of a material having a higher melting temperature than said metal and said blade with said bracket interposed between said blade and said vent for protecting said blade and metal from arc gasses generated in response to disengagement of said contacts.

20. A circuit breaker for use in a panelboard having a bus bar to supply electrical power to a load, comprising:

a pair of contacts with one of said contacts adapted to be connected to said bus bar, pivot means for pivoting the other contact in one direction about a contact axis transverse to the axis of said bar for engagement with said one contact to extend power from said one contact to a load and disengaged from said one contact in response to pivoting movement in the opposite direction about said contact axis to interrupt said power to said load, means for sensing the current level passing through said contacts, an operating assembly having a handle arranged for pivoting movement about a handle axis to control said operating assembly for movement to an ON position in response to rotation of said handle in a respective direction about said handle axis and into an OFF position in response to rotation of said handle in the opposite said respective direction about said handle axis, cam means interconnecting said operating assembly and pivot means in response to movement of said operating assembly in said respective direction for pivoting said other contact in said one direction about said contact axis to engage said other contact with said one contact and interconnecting said cam means and said pivot means in response to movement of said operating assembly opposite said respective direction for pivoting said other contact in said other direction about said contact axis to disengage said other contact from said one contact, spring means effective in response to initial pivoting of said other contact in said one and other directions about said contact axis past a predetermined position for thereafter snap actingly moving said other contact in the respective one and other direction independently of said cam means, and means controlled by said sensing means for moving said operating assembly from said ON position to a trip position, intermediate said ON and OFF position in response to the sensing of a fault current level passing through said contacts whereby said cam means controls said pivot means to pivot said other contact in said other direction past said predetermined position to disengage said other contact from said one contact.

21. The circuit breaker claimed in claim 20 in which said operating assembly includes a plurality of links each pivotable about a respective axis parallel to said handle axis with one link having a translatable axis, said cam means includes a pair of spaced cam fingers pivotable about an axis transverse to each respective axis and parallel to said contact axis, and said operating assembly includes a main spring having one end fixed adjacent said handle axis and the other end fixed to said translatable axis.

22. The circuit breaker defined in claim 21 in which said operating assembly includes retaining means for retaining said translatable axis second pivot pin translated against the tension in said main spring in response to said handle being rotated opposite said respective direction prior to rotation in said first direction, and said cam means includes a bracket pivotally supported for translation with said translatable axis, a cam member, means for pivotally supporting said cam member for rotation about said axis transverse to each respective axis, and means responsive to translation of said bracket in said selected direction for rotating said cam member about said axis transverse to each respective axis.

23. In the circuit breaker claimed in claim 20, trip indicator means operable in response to movement of said operating assembly to said trip position for providing a visual signal corresponding to said fault current level.

24. In the circuit breaker claimed in claim 23, means for moving said operating assembly to said trip position and for operating said trip indicator means in response to operation of said sensing means irrespective of the movement of said handle in said respective direction.

25. The circuit breaker claimed in claim 22 in which rotation of said handle opposite said respective direction in said horizontal plane is ineffective to translate said translatable axis in the event said contacts are welded closed.

26. A circuit breaker for use in a panelboard having a bus bar extending in a vertical plane from either the top or bottom of said panelboard to supply electrical power to a load comprising:

a pair of contacts with one of said contacts adapted to be connected to said bus bar, pivot means for pivoting the other contact in one direction about a contact axis transverse to the axis of said bar for engagement with said one contact to extend power from said one contact to a load and disengaged from said one contact in response to pivoting movement in the opposite direction about said contact axis to interrupt said power and said load, means for sensing a fault current passing through said contacts, an operating assembly having a handle arranged for pivoting movement about a handle axis transverse to said contact axis and substantially parallel to the longitudinal axis of said bus bar from controlling said operating assembly to move to an ON position in response to rotation of said handle in one direction about said handle axis and to an OFF position in response to rotation of said handle in the opposite direction about said handle axis, a cam member rotatable in a selected direction about a last axis parallel to said contact axis and transverse to the longitudinal axis of said bus bar in response to movement of said operating assembly toward said ON position and rotatable opposite said selected direction in response to movement of said operating assembly toward said OFF position, radial means interconnecting said cam member and pivot means in response to rotation of said cam member in said selected direction for pivoting said other contact in said one direction about said contact axis to engage said other contact with said one contact and interconnecting said cam member and said pivot means in response to rotation of said cam member opposite said selected direction for pivoting said other contact in said other direction about said contact axis to disengage said other contact from said one contact, spring means effective in response to initial pivoting of said other contact in said one and other directions about said contact axis past a predetermined position for thereafter snap actingly moving said other contact in the respective one and other direction independently of said cam member means, and last means controlled by said sensing means for moving said operating assembly from said ON position to a trip position intermediate said ON and OFF position in response to the sensing of a fault condition and for indicating the trip condition of said circuit breaker, said last means controlling said cam member together with said radial means to pivot said other contact in said other direction to disengage other contact from said one contact.

27. A circuit breaker comprising, a housing carrying a pair of terminals with one of said terminals adapted to be connected to a source of power and the other terminal adapted to be connected to load, a pair of contacts in said housing with one of said contacts connected to said other terminal, a blade bracket of relatively high melting temperature supporting the other contact for pivoting movement in one direction to engage said one contact and for pivoting movement in another direction to disengage said other contact from said one contact, said blade bracket includes a U-shaped member having pivotally supported side legs and a back wall secured to said metal and of greater width than said metal with said back wall interposed between said arc and said metal in response to pivoting movement in said other direction, a metal of relatively low melting temperature connecting said one terminal to said other contact, means for sensing the current level passing through said contacts, an operating assembly adapted to be manually controlled to move said blade bracket for moving the other contact to engage said one contact and controlled by said sensing means in response to said sensing means sensing a current above a predetermined value for disengaging said other contact from said one contact, and a vent in said housing at a position spaced below said one terminal for venting gases from said housing in the event an arc develops between said contacts with a portion of said blade bracket interposed between said vent and said metal of relatively low melting temperature.

28. A circuit breaker for use in a panelboard having a bus bar to supply electrical power to a load, comprising:

a pair of contacts with either one of said contacts adapted to be connected to said bus bar, pivot means for pivoting one of said contacts in one direction about a contact axis for engagement with the other of said one contacts to extend power from said bus bar to a load and disengaged from said other contact in response to pivoting movement in the opposite direction about said contact axis to interrupt said power to said load, means for sensing the current level passing through said contacts, an operating assembly having a handle arranged for pivoting movement about a handle axis to control said operating assembly for movement to an ON position in response to rotation of said handle in an ON direction about said handle axis and into an OFF position in response to rotation of said handle in an OFF direction about said handle axis, cam means interconnecting said operating assembly and pivot means in response to movement of said operating assembly in said ON direction for pivoting said one contact in said one direction about said contact axis to engage said one and other contacts and interconnecting said cam means and said pivot means in response to movement of said handle in said OFF direction for pivoting said one contact in said other direction about said contact axis to disengage said one contact from said other contact, spring means effective in response to initial pivoting said one contact in said one and other directions about said contact axis past a predetermined position for thereafter snap actingly moving said one contact in the respective one and other direction independently of said cam means, trip means controlled by said sensing means for moving said operating assembly from said ON position to a trip position intermediate said ON and OFF position irrespective of the rotation of said handle in said ON direction in response to the sensing of a fault current above a predetermined level passing through said contacts by said sensing means whereby said cam means controls said pivot means to pivot said one contact in said other direction past said predetermined position to disengage said one contact from said other contact, and trip indicating means operated in response to the movement of said operating assembly to said trip position for providing a visual signal corresponding to said trip position.

29. In the circuit breaker claimed in claim 28, means preventing movement of said handle past a selected position in said OFF direction and operation of said trip indicating means in the event said contacts are welded.

* * * * *